US008739988B2

(12) United States Patent
Walker

(10) Patent No.: US 8,739,988 B2
(45) Date of Patent: Jun. 3, 2014

(54) PINNED CONNECTION SYSTEM FOR CRANE COLUMN SEGMENTS

(75) Inventor: Robert J. Walker, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 151 days.

(21) Appl. No.: 13/236,307

(22) Filed: Sep. 19, 2011

(65) Prior Publication Data

US 2012/0067840 A1 Mar. 22, 2012

Related U.S. Application Data

(60) Provisional application No. 61/384,709, filed on Sep. 20, 2010.

(51) Int. Cl.
*B66C 23/70* (2006.01)

(52) U.S. Cl.
USPC ..... 212/177; 212/300; 212/175

(58) Field of Classification Search
USPC ..... 212/175–77, 300
See application file for complete search history.

(56) References Cited

U.S. PATENT DOCUMENTS

| | | | | | |
|---|---|---|---|---|---|
| 844,990 | A * | 2/1907 | Allan et al. | ..... | 212/176 |
| 2,529,454 | A * | 11/1950 | Marcantonio | ..... | 212/300 |
| 2,649,210 | A * | 8/1953 | Marchese | ..... | 212/300 |
| 2,975,910 | A * | 3/1961 | Conrad | ..... | 212/300 |
| 3,080,068 | A * | 3/1963 | Felkner | ..... | 212/177 |
| 3,085,695 | A * | 4/1963 | Miller | ..... | 212/300 |
| 3,430,778 | A * | 3/1969 | Brown | ..... | 212/300 |
| 4,394,914 | A * | 7/1983 | Privat | ..... | 212/203 |
| 4,400,994 | A * | 8/1983 | Skjaeveland | ..... | 74/520 |
| 4,484,686 | A * | 11/1984 | Mentzer | ..... | 212/300 |
| 4,653,655 | A * | 3/1987 | Rathi et al. | ..... | 212/300 |
| 5,016,767 | A * | 5/1991 | Thibault | ..... | 212/300 |
| 5,082,128 | A * | 1/1992 | Franzen et al. | ..... | 212/347 |
| 5,140,929 | A * | 8/1992 | Gaspard | ..... | 212/270 |
| 5,199,586 | A * | 4/1993 | Pech et al. | ..... | 212/175 |
| 5,406,767 | A * | 4/1995 | Pech et al. | ..... | 52/638 |
| 5,487,479 | A * | 1/1996 | Pech et al. | ..... | 212/270 |
| 6,213,318 | B1 * | 4/2001 | Walker | ..... | 212/177 |
| 6,296,419 | B1 * | 10/2001 | Millet et al. | ..... | 403/408.1 |

(Continued)

FOREIGN PATENT DOCUMENTS

| | | | |
|---|---|---|---|
| DE | 44 02 005 A1 | 7/1995 | |
| EP | 2 065 332 A2 | 6/2009 | |
| EP | 2065332 A2 * | 6/2009 | ..... B66C 23/70 |

*Primary Examiner* — Emmanuel M Marcelo
*Assistant Examiner* — Michael Gallion
(74) *Attorney, Agent, or Firm* — Brinks Gilson & Lione; Steven P. Shurtz

(57) ABSTRACT

A crane includes first and second column segments. At least a first, third and fifth connector are located on the first segment, respectively mating with at least a second, fourth and sixth connector on the second segment. Each of the connectors includes at least a first extension having a through-hole positioned in the extension such that the through-holes of mating connectors are aligned when the column segments are aligned. A first pin fits tightly through the through-hole of the first extension on the first connector and the through-hole of the first extension on the second connector to hold the first and second connectors together. A second pin fits loosely through the through-hole of the first extension on the third connector and the through-hole of the first extension on the fourth connector to hold the second and fourth connectors together. The connectors also include a compressive load bearing surface.

20 Claims, 6 Drawing Sheets

(56) References Cited

U.S. PATENT DOCUMENTS

| | | | | |
|---|---|---|---|---|
| 7,156,245 | B2 * | 1/2007 | Lissandre | 212/177 |
| 7,337,912 | B1 * | 3/2008 | Hull | 212/300 |
| 7,537,126 | B2 * | 5/2009 | Kurotsu et al. | 212/300 |
| 7,703,615 | B2 * | 4/2010 | Willim | 212/175 |
| 2002/0023891 | A1 * | 2/2002 | Verchere et al. | 212/300 |
| 2002/0053550 | A1 * | 5/2002 | Stoof | 212/176 |
| 2004/0238471 | A1 * | 12/2004 | Lissandre | 212/177 |
| 2005/0011850 | A1 * | 1/2005 | Hinrichs et al. | 212/300 |
| 2008/0173605 | A1 * | 7/2008 | Willim | 212/177 |

* cited by examiner

PINNED CONNECTION SYSTEM FOR CRANE COLUMN SEGMENTS

REFERENCE TO EARLIER FILED APPLICATION

The present application claims the benefit of the filing date under 35 U.S.C. §119(e) of Provisional U.S. Patent Application Ser. No. 61/384,709, filed Sep. 20, 2010, which is hereby incorporated by reference in its entirety.

BACKGROUND OF THE INVENTION

The present invention relates to lift cranes, and more particularly to connection systems for connecting sectional column members for cranes and the like.

Large capacity lift cranes typically have elongate load supporting column structures, such as the crane boom, mast and jib structure, comprised of sectional column members secured in end-to-end abutting relationship. Predominantly, each of the sectional column members is made of a plurality of chords and lacing or lattice elements. The terminal end portions of each chord are generally provided with connectors of one form or another to secure abutting column segments together and to carry compressive loads between abutting chords. Typical connectors comprise male and female lugs secured by a pin carrying compressive loads in double shear.

An example 220 foot boom may be made of a 40 foot boom butt pivotally mounted to the crane upper works, a 30 foot boom top equipped with sheaves and rigging for lifting and supporting loads, with five sectional boom members in between: one 10 feet in length, one 20 feet in length and three 40 feet in length. Such an example boom has six boom segment connections. Typically each segment has four chords, and hence four connectors, making a total of 24 connectors that must be aligned and pinned to assemble the boom.

Large capacity cranes require very large boom cross sections. As a result, even when the boom segments are laying flat on the ground, the pin connectors between the top chords are typically eight feet or higher off the ground. The rigging personnel must either move a step ladder to each pin location or stand and walk along the top of the boom to reach the top connectors.

A 40 foot long sectional boom member may weight over 50,000 lbs. Thus, an assist crane is required to lift the boom member. One rigger usually then holds the suspended boom segment in general alignment while a second rigger uses a large hammer (10 or 15 lbs.) to manually drive the pin, which typically has a long taper, into position. The pins connecting the boom segments are generally used to carry the compressive loads between chords. As a result, the pins have a tight fit, further increasing the difficulty in assembling the boom. As such, it may take three men (a crane operator and two riggers) four or more hours to assemble the example 220 foot boom. Where the crane is moved frequently, the costs to assemble and disassemble the boom may exceed the cost to lift and position the load for which the crane is used.

To carry very high loads for a high capacity crane, a typical single male lug sandwiched between two female lugs, giving a double shear connection, requires a very large pin diameter to carry the compressive loads, requiring the connectors to be very large. There are known connectors with three female lugs and two male lugs, but there is no provision for these types of boom connections to provide for any self-alignment or rotatable connection (where the boom segments can be initially connected when not axially aligned and then swung into a position where the reminder of the connections can be made) between the boom sections as the sections are assembled.

Thus, an easy, quick-connect system for boom segments that allows faster connection of the boom segments and an initial connection from a position where the boom segments are not in axial alignment would be a great improvement.

In addition, if the column segment connections are large, and carry large loads, the pins that hold the connections together may be very large, making them very heavy and difficult to put in place. If the connection were somehow designed to use more pins, such as two pins for every connection, the size and weight of the pins could be reduced. However, this would double the number of pins that had to be installed, and increase the amount of time it takes to assemble the crane. Thus, a pinned connection system that could cut down on the assemble time for the crane would also be very beneficial.

BRIEF SUMMARY

An improved connection system for crane column segments, such as a boom segments, has been invented. With the invention, boom segments have connectors that include at least one tight fitting pin that can be initially used to hold the boom segments together while other pins, which may have a looser fit, are then inserted to finish the connection. In the preferred embodiment, each connector includes two pins, thus reducing the size of each pin. However, because some of the pins are looser they can be inserted more easily, making it possible to speed up the boom assembly process. Further, alignment surfaces and/or stop surfaces on the preferred connectors allow the connectors to be easily aligned for insertion of the pins, and allow the boom segments to be initially connected and then rotated into a final position where the remainder of the connections between segments can be made.

In a first aspect, the invention is a crane having an upper works rotatably mounted on a lower works, the crane including at least one column member, the column member comprising: at least a first and a second column segment each with a longitudinal axis and a first and a second end, the second end of the first segment being coupled to the first end of the second segment; at least a first, a third and a fifth connector on the second end of the first segment respectively mating with at least a second, a fourth and a sixth connector on the first end of the second segment; each of the connectors comprising at least a first extension having a through-hole there through, the through-hole having an axis perpendicular to said longitudinal axis and positioned in the extension such that the through-holes of mating connectors are aligned when the column segments are aligned; each of the connectors comprising a compressive load bearing surface, the compressive load bearing surfaces being positioned to carry compressive loads between the first and second column segments when the column segments are aligned; a first pin fining tightly through the through-hole of the first extension on the first connector and the through-hole of the first extension on the second connector to hold the first and second connectors together; and a second pin fitting loosely through the through-hole of the first extension on the third connector and the through-hole of the first extension on the fourth connector on the first end of the second segment to hold the second and fourth connectors together.

In a second aspect, the invention is a mated connection between two sectional column members comprising: a first connector affixed to an end of a first sectional column member and a second connector affixed to an end of a second sectional column member; each first and second connector having a first and second set of extensions, with each extension having a through-hole there through sized to receive a pin; each connector also comprising a compressive load bearing surface positioned between the first set and second set of extensions, the compressive load bearing surface of the first connector being in face-to-face relationship with the compressive load bearing surface of the second connector; and a first pin passing through the through-holes of the first set of extensions of the first connector and the first set of extensions of the second connector in a tight fitting mariner, and a second pin passing through the through-holes of the second set of extensions of the first connector and the second set of extensions of the second connector in a loose fitting manner.

In another aspect, the invention is a method of connecting first and second segments of a lift crane column, the column segments each comprising a longitudinal axis and at least three chords, with each of the chords having a connector on each end thereof, the method comprising: a) bringing the two column segments together such that at least one extension having a through-hole there through on at least a first connector on the first column segment is interleaved respectively with at least two extensions having a through-hole there through on at least a second respective connector on the second column segment to form at least a first pair of mated connectors, with the through-holes in the connector extensions being generally aligned; b) fastening the mated first and second connectors together with a pin that fits tightly in the through-holes of the extensions, providing a pivoting connection; and c) pinning the previously non-coupled connectors to their respective mating connector with a loose fitting pin.

With the preferred embodiment of the invention, large sections of a lift crane boom or other crane column members can be assembled with a faster set-up time. One of the pins can be tight fitting, which may need to be put in place with a hydraulic cylinder, but other pins can be more loosely fit, allowing them to be inserted more quickly, and without the need of a hydraulic cylinder. Thus a second set of riggers can insert the other pins while riggers with a hydraulic pin pusher move to the next segment connection. Further, if the segments need to be connected from a non-aligned positioned, once the more tightly fitting pin or pins are in place, the sections can be pivoted into and will automatically stop in an aligned configuration with the through-holes on the remaining connectors already lined up. With the preferred embodiment of the invention, smaller diameter pins are used, with two pins on each connection. However, the use of the invention means that only the top pin or pins on each upper chord are tight fitting, while the remaining pins are more loosely fit.

These and other advantages of the invention, as well as the invention itself, will best be understood in view of the drawings, a brief description of which is as follows.

DETAILED DESCRIPTION OF THE PREFERRED EMBODIMENTS

Figure 1:
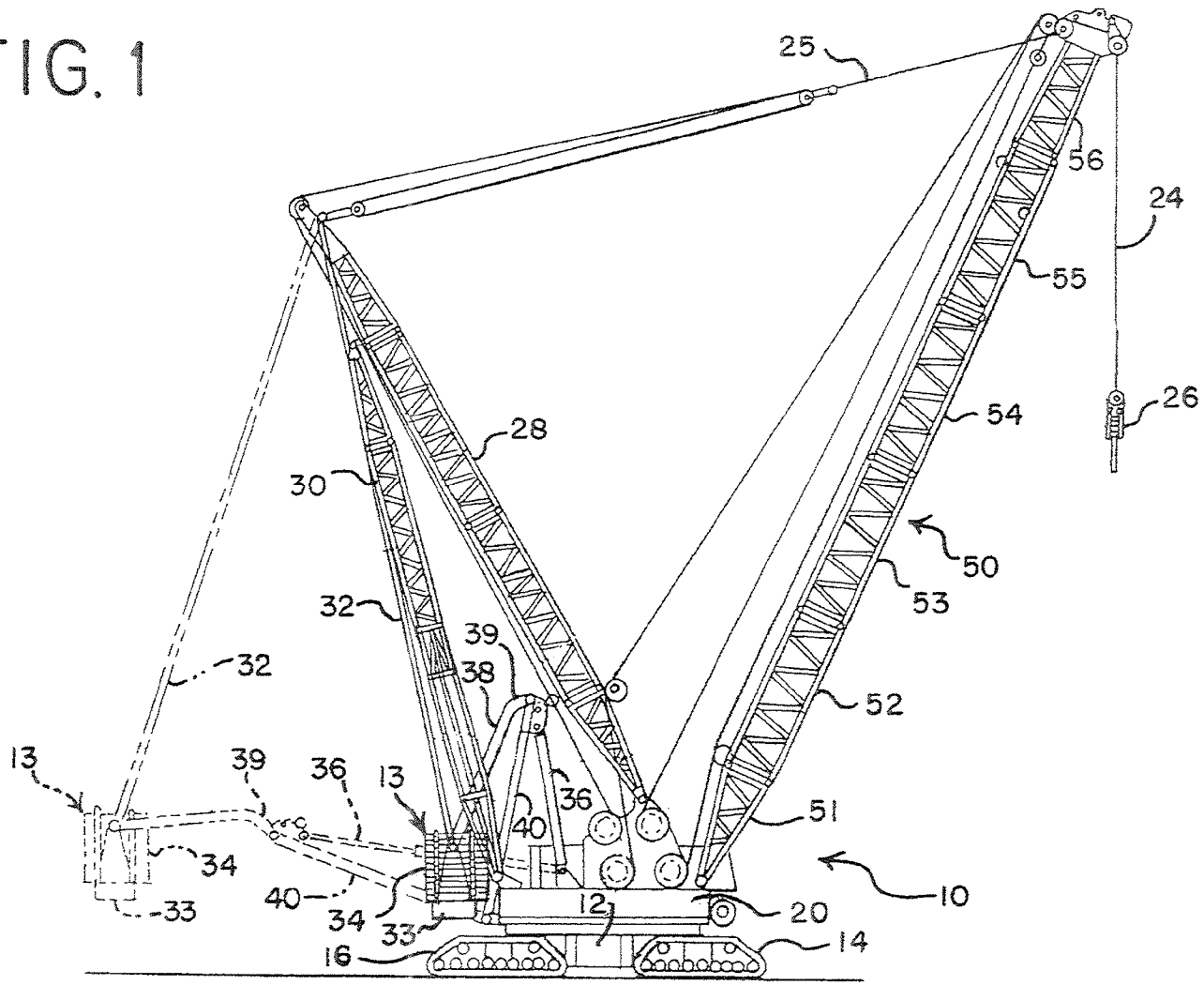
FIG. 1 is a side elevational view of a crane with a sectional boom utilizing the pinned column segment connection system of the present invention.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The preferred embodiment of the present invention relates to a high capacity mobile lift crane, other aspects of which are disclosed in U.S. Pat. No. 7,546,928 (Mobile Lift Crane With Variable Position Counterweight), U.S. Pat. No. 7,762,412 (Mast Raising Structure And Process For High-Capacity Mobile Lift Crane), U.S. Pat. No. 7,946,560 (Crane Hook Block), U.S. Pat. No. 7,954,657 (Connection System For Crane Boom Segments), U.S. Pat. No. 7,967,158 (Mobile Lift Crane With Variable Position Counterweight) and U.S. Pat. No. 7,997,432 (Trunnion Transportation System And Crane Using Same), and the following co-pending United States patent applications assigned to the assignee of the present application: "Drive Tumbler And Track Drive For Mobile Vehicles, including Lift Cranes," Ser. No. 12/368,143, filed Feb. 9, 2009, "Track Connection System For Mobile Vehicles, Including Lift Cranes," Ser. No. 12/368,125, filed Feb. 9, 2009, "Track Tensioning System For Mobile Vehicles, Including Lift Cranes," Ser. No. 12/368,113, filed Feb. 9, 2009, "Boom Hoist Transportation System And Crane Using Same," Ser. No. 12/561,007, filed Sep. 16, 2009, Carbody Connection System And Crane Using Same," Ser. No. 12/561,103, filed Sep. 16, 2009, "Drum Frame System For Cranes," Ser. No. 12/561,094, filed Sep. 16, 2009, Swing Drive System For Cranes," Ser. No. 12/710,960, filed Feb. 23, 2010, "Counterweight Block And Assemblies For Cranes," Ser. No. 12/718,156, filed Mar. 5, 2010, "Folding Jib Main Strut And Transportable Revved Strut Caps," Ser. No. 12/730,421, filed Mar. 24, 2010, "Compressible Stop Member For Use On A Crane," Ser. No. 12/781,739, filed May 17, 2010, and "Crane Backstay Spreader," Ser. No. 12/777,094, filed May 10, 2010. Each of these patents and applications is hereby incorporated by reference.

For ease of reference, designation of "top," "bottom," "horizontal" and "vertical" are used herein and in the claims to refer to portions of a sectional boom in a position in which it would typically be assembled on or near the surface of the ground. These designations still apply although the boom may be raised to different angles, including a vertical position.

The diameters referred to are the diameters of the operational sections of the pins, excluding any tapered section. Parts being designated as the same size means that they are the same size within normal tolerances for crane parts of their nature. "Tight fitting" and "loose fitting" are relative terms, meaning the tightness of one pin in the hole it is designated for compared to the tightness of fit of another pin in its hole. In the preferred embodiment, with two upper connectors and two lower connectors on each column segment, the desirable tightness of the fit of the top pins and the desired looseness of the bottom pins is dependent on the column segment configurations. However, in the present invention, the top pins will have a significantly different tightness of fit than the bottom pins. Examples below provide meaningful understanding of the terms "tight" and "loose".

The mobile lift crane 10, as shown in FIG. 1, includes lower works, also referred to as a carbody 12, and moveable ground engaging members in the form of crawlers 14 and 16. (There are of course two front crawlers 14 and two rear crawlers 16, only one each of which can be seen from the side view of FIG. 1.) In the crane 10, the ground engaging members could be just one set of crawlers, one crawler on each side. Of course additional crawlers than those shown, or other ground engaging members such as tires, can be used.

A rotating bed 20 is rotatably connected to the carbody 12 using a roller path, such that the rotating bed 20 can swing about an axis with respect to the ground engaging members 14, 16. The rotating bed supports a boom 50 pivotally mounted on a front portion of the rotating bed; a mast 28 mounted at its first end on the rotating bed; a backhitch 30 connected between the mast and a rear portion of the rotating bed; and a moveable counterweight unit 13 having counterweights 34 on a support member 33. The counterweights may be in the form of multiple stacks of individual counterweight members on the support member 33.

Boom hoist rigging 25 between the top of mast 28 and boom 50 is used to control the boom angle and transfers load so that the counterweight can be used to balance a load lifted by the crane. A hoist line 24 extends from the boom 50, supporting a hook 26. The rotating bed 20 may also includes other elements commonly found on a mobile lift crane, such as an operator's cab and hoist drums for the rigging 25 and hoist line 24. If desired, the boom 50 may comprise a bluffing jib pivotally mounted to the top of the main boom, or other boom configurations. The backhitch 30 is connected adjacent the top of the mast 28. The backhitch 30 may comprise a lattice member designed to carry both compression and tension loads as shown in FIG. 1. In the crane 10, the mast is held at a fixed angle with respect to the rotating bed during crane operations, such as a pick, move and set operation.

The counterweight unit is moveable with respect to the rest of the rotating bed 20. In the crane embodiment depicted, the counterweight unit 13 is designed to be moved in and out with respect to the front of the crane in accordance with the invention disclosed in U.S. Pat. No. 7,546,928 (Mobile Lift Crane With Variable Position Counterweight) and U.S. Pat. No. 7,967,158 (Mobile Lift Crane With Variable Position Counterweight). A tension member 32 connected adjacent the top of the mast supports the counterweight unit. A counterweight movement structure is connected between the rotating bed and the counterweight unit such that the counterweight unit may be moved to and held at a first position in front of the top of the mast, shown in solid lines in FIG. 1, and moved to and held at a second position rearward of the top of the mast, shown in dotted lines in FIG. 1.

In the crane 10, a hydraulic cylinder 36, pivot frame 40 and a rear arm 38 may be used to move the counterweight unit. (As with the crawlers, the rear arm 38 actually has both left and right members, only one of which can be seen in FIG. 1, the pivot frame has two side members, and the hydraulic cylinder comprises two cylinders that move in tandem. Alternatively, one larger hydraulic cylinder, or a rack and pinion structure, powered by preferably four hydraulic motors, could be used in place of the two hydraulic cylinders 36 to provide the linear actuation. Further, the pivot frame could be made as a solid plate structure, and the two rear arms 38 could be replaced by one single structure.) The pivot frame 40 is connected between the rotating bed 20 and hydraulic cylinder 36, and the rear arm 38 is connected between the pivot frame 40 and the counterweight unit. The hydraulic cylinder 36 is pivotally connected to the rotating bed 20 on a support frame which elevates the hydraulic cylinder 36 to a point so that the geometry of the cylinder 36, pivot frame 40 and rear arm 38 can move the counterweight through its entire range of motion. In this manner the cylinder 36 causes the rear arm 38 to move the counterweight unit when the cylinder is retracted and extended.

Arms 38 have an angled portion 39 at the end that connects to the pivot frame 40. This allows the arms 38 to connect directly in line with the side members of pivot frame 40. The angled portion 39 prevents the arms 38 from interfering with the side members of the pivot frame the when the counterweight is in the position shown in solid lines in FIG. 1.

The boom 50 is made of several sectional members, including a boom butt 51, boom insert segments 52, 53, 54 and 55, which may vary in number and be of different lengths, and a boom top 56. The sectional boom members 51-56 typically are comprised of multiple chords.

Each boom segment 53 and 54 has a rectangular cross section with a chord at each corner. The segments 53 and 54, which are representative and may be considered as first and second boom segments, each have a longitudinal axis 41 (FIG. 2), as well as first and second ends. The second end of the first segment 53 is coupled to the first end of the second segment 54. There are two top chords 61 and two bottom chords 63 (only one of each of which can be seen in the side views) interconnected by intermediate lacing or lattice elements 65 connecting the chords into a fixed, parallel relationship forming the boom segment. In the embodiment shown, the chord members are made of steel with a circular, tubular cross section. A horizontal plane containing the longitudinal axis 41 can be considered to divide the boom segment into first and second longitudinal portions 67 and 68, with the two top chords 61 being present in the first portion 67 and the two bottom chords 63 being present in the second longitudinal portion of the boom segment 68. These particular first and second longitudinal portions are identified for ease in explaining the invention. Of course other configurations of boom segments are possible with a differing number of chords, and different ways of designating longitudinal portions of the boom segments are possible.

Each chord member has a vertical neutral axis and a horizontal neutral axis. Compressive loads applied at the intersection of the vertical and horizontal neutral axes of a chord, or symmetrically about the horizontal and vertical neutral axes, will not induce bending moments within the chord. Thus it is preferable that connectors that are used to connect boom segments together are mounted on the boom segments at the ends of the chords such that compressive loads transmitted through the connectors are symmetrical about the neutral axes of the chords.

Figure 2:
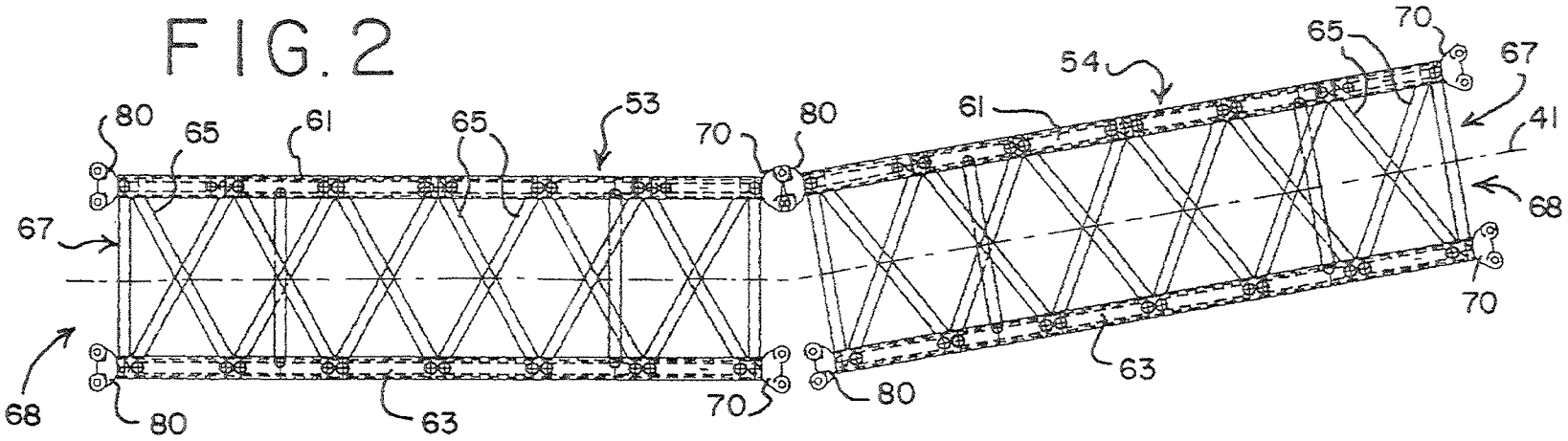
FIG. 2 is a side elevational view of two boom segments being brought together from a first position to form the boom on the crane of FIG. 1.
Figure 3:
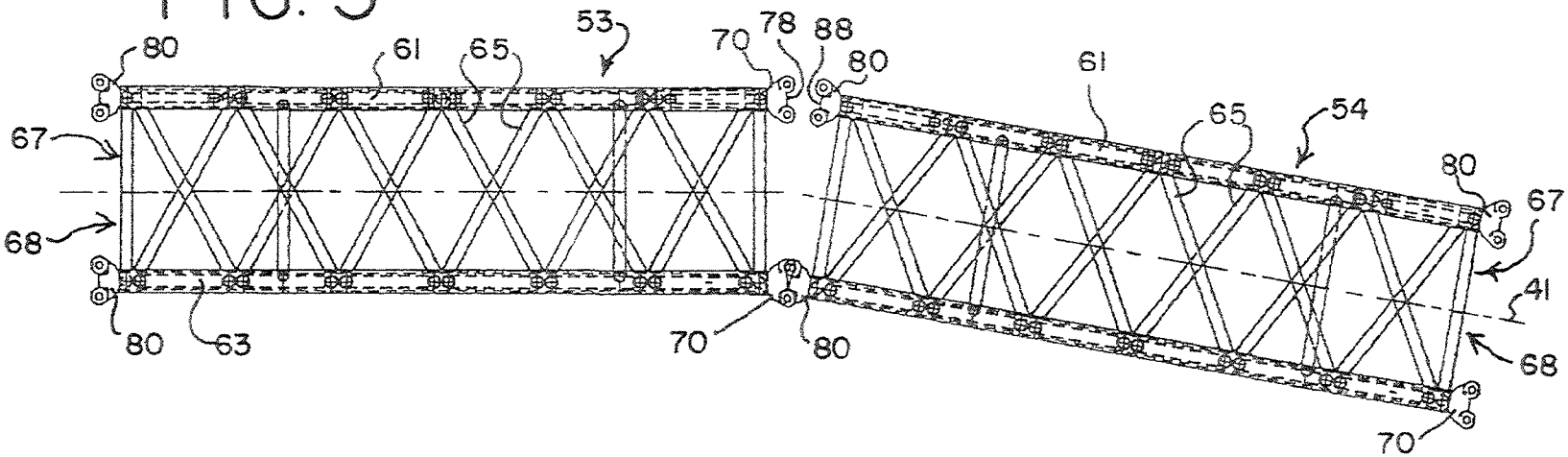
FIG. 3 is a side elevational view of the two boom segments of FIG. 2 being brought together from a second position to form the boom on the crane of FIG. 1.

As shown in FIG. 2, with the preferred boom segment connection system of the present invention, either the connectors on the top chords 61 can be connected first, or, as shown in FIG. 3, the connectors on the bottom chords 63 can be connected first, while the boom segments are in a non-aligned configuration. As explained in detail below, with the preferred connectors, the boom segments can then be pivoted and will automatically stop in a position where the additional connectors are aligned. It is also possible that the boom segments can be brought together with the longitudinal axes of the segments already lined up. In the preferred alignment system of the present invention, the configuration of the connectors facilitates such an alignment and coupling of the boom segments, also as explained in more detail below.

The connectors of the first embodiment are of two types, which may be referred to as first and second connectors, shown in detail in FIGS. 8-11. Each connector includes at least one extension having an aperture in the form of a through-hole there through sized to receive a pin, the extensions extending away from the boom segments to which they are attached, and the aperture having an axis perpendicular to that longitudinal axis. The extensions and apertures are positioned on their respective connectors such that when the second end of the boom segment is in an aligned position with and coupled to the first end of an identical boom segment, with connectors on the two boom segments coupled together, the extensions of the coupled connectors overlap one another and the apertures are aligned such that the pin may be inserted through the apertures to secure the connector of the second end of the boom segment to the connector of the first end of an identical boom segment. (It should be appreciated that while the connectors are discussed as connecting with connectors on identical boom segments, cranes utilizing the present invention do not need to use identical boom segments—this terminology is used just to help explain the connection process. Inventive boom segments used in the boom may differ in a number of respects, particularly in regard to features that have to do with crane assembly and operation other than the segment-to-segment connection system.) Preferably half of the connectors have a first number of extensions and half of the connectors have a second number of extensions, the second number being one greater than the first number, the connector on opposite ends of each chord having a different number of extensions from each other.

The connector on the first end of the chord of the first longitudinal portion of the boom segment includes a first alignment surface and a stop surface. The connector on the second end of the chord of the first longitudinal portion of the boom segment includes a second alignment surface and a stop surface. In this embodiment, these surfaces are provided by different structures on the connectors.

The first and second alignment surfaces cooperate such that when the first and second connectors are being brought together during boom assembly, the alignment surfaces urge the boom segments into a relative position such that the apertures through the extensions in the connectors are aligned sufficiently such that a tapered pin can be inserted through the apertures of the extensions in the first and second mating connectors even if the boom segments are not axially aligned. The placement of the stop surface on the connectors are such that, when an identical boom segment is positioned such that a pin can be inserted through the apertures in the extensions of the connectors of the remainder of the chords on the second longitudinal portion of the boom segments, the stop surfaces cooperate to align the apertures in the extensions of their respective connectors when the stop surfaces contact one another.

Figure 4:
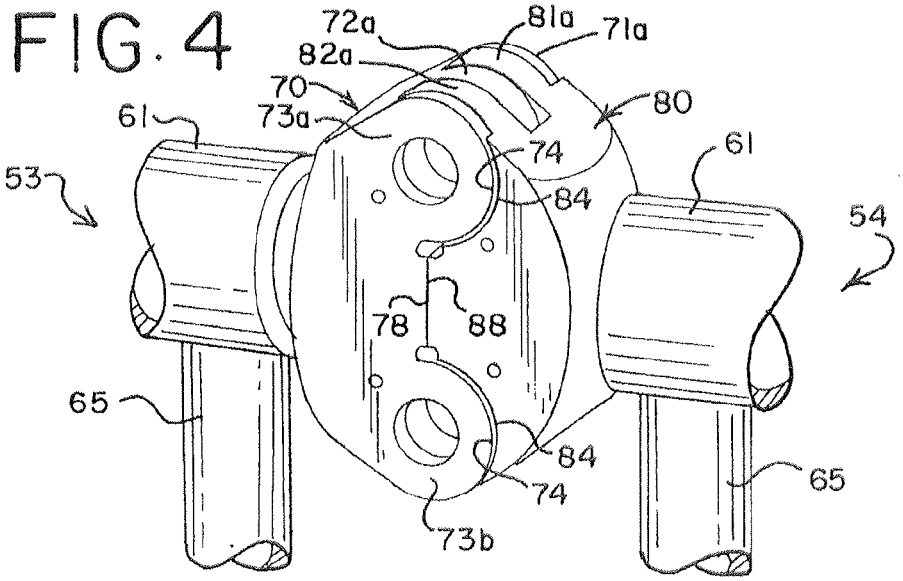
FIG. 4 is a perspective view of a mated pair of connectors used to connect the boom segments of FIG. 2.
Figure 5:
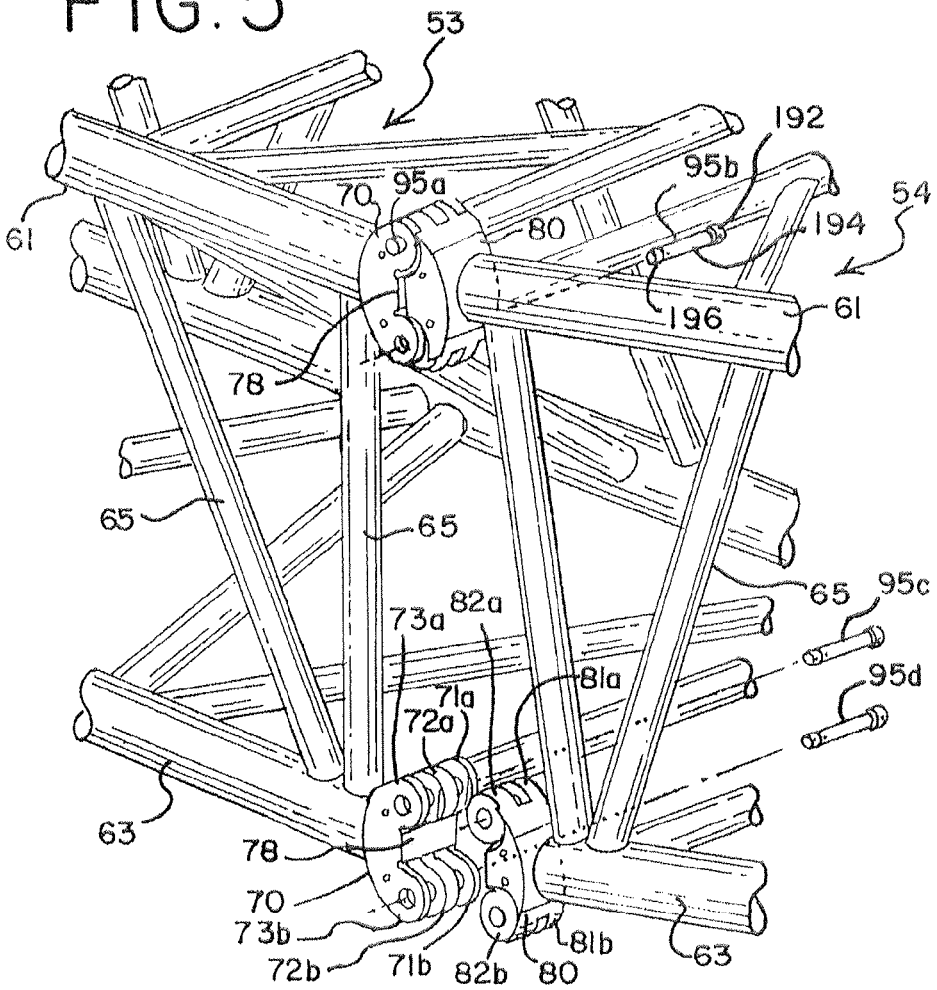
FIG. 5 is a perspective view of the ends of two boom segments of FIG. being assembled.

FIG. 4 shows a mated connection between two sectional boom members 53 and 54. A first connector 70 is affixed to the second end of a top chord 61 on a first sectional boom member 53. The connector 70 has two sets of three extensions 71*a*, 72*a*, and 73*a*, and 71*b*, 72*h* and 73*b* (best shown in FIG. 5), each having an aperture there through in the form of a through-hole. The connector 70 also includes a first alignment surface in the form of rounded outer surfaces 74 on the distal ends of each extension. The connector 70 further comprises a generally flat, compressive load bearing surface 78 that extends across the width of the connector and separates the two sets of extensions. In this embodiment, the load bearing surface 78 provides the stop surface for the connector.

Figure 10:
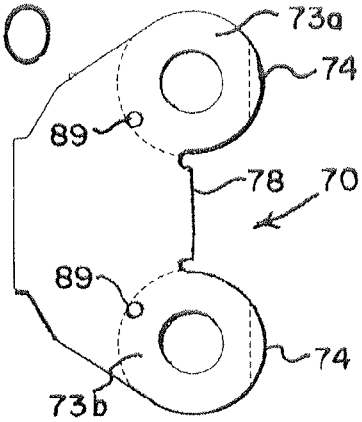
FIG. 10 is an enlarged side elevational view of the female connector of FIG. 8.
Figure 11:
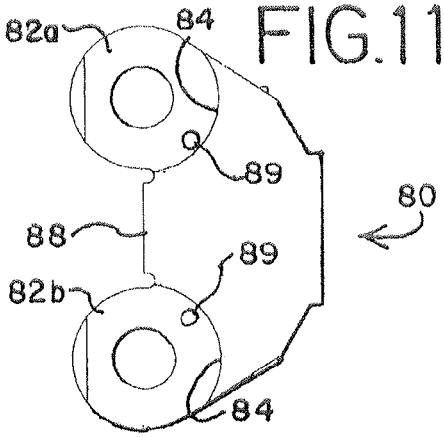
FIG. 11 is an enlarged side elevational view of the male connector of FIG. 9.

The second connector 80 is affixed to the first end of a top chord 61 on a second sectional boom member 54. The second connector 80 has two sets of two extensions 81*a* and 82*a*, and 81*b* and 82*b*, each having an aperture there through in the form of a through-hole. The extensions 71, 72 and 73 of each set on connector 70 are interleaved with the respective set of extensions 81 and 82 on connector 80 when the connectors are coupled together, as seen in FIG. 4. The connector 80 has second alignment surfaces in the form of pockets 84 adjacent the base of the outside portions of the extensions 81 and 82 matching the shape of the rounded outer surfaces 74. Drain holes 89 are provided in each connector 70, 80, as shown in FIGS. 10 and 11. The connector 80 also includes a generally flat, compressive load bearing surface 88 extending across the width of the connector. In this embodiment, the load bearing surfaces 78 and 88 provide the stop surfaces for the connector.

When a pin (not shown in FIG. 4) is placed through the apertures of the interleaved extensions 71*a*, 81*a*, 72*a*, 82*a* and 73*a*, securing the connectors 70 and 80 in a pivotal relationship, the second alignment surfaces 84 and rounded first alignment surfaces 74 are in close proximity but not quite in contact with one another when the boom segments are in axial alignment, as shown in FIG. 4. However, as shown in FIG. 2, when the boom sections 53 and 54 are not in axial alignment, the connectors 70 and 80 can still be coupled to one another. In that instance, the first alignment surfaces 74 and second alignment surfaces 84 will contact one another as the boom sections are brought close to one another. When they are in contact, the apertures in the extensions 71, 72, 73, 81 and 82 are in close enough alignment that a tapered pin (shown in FIG. 5*b*) may be inserted through the apertures, meaning that it can start to be inserted, and the taper on the pin will cause the apertures to fully align as the pin is driven through the apertures.

Thereafter, when the boom segments are pivoted about this first pin, the compressive load bearing surface 78 will contact the compressive load bearing surface 88 to stop the pivoting at the point where the boom segments are aligned. Thus the stop surfaces are positioned such that if one set of first and second connectors are coupled together by a pin through their apertures and the boom. segments are in a non-aligned position, rotation of the boom segments about the pin through the apertures of the coupled connectors to the point where the stop surfaces of the additional connectors on the boom segments contact one another will bring the boom segments into alignment and the apertures on those additional connectors into alignment. After the segments 54 and 56 are in axial alignment, another pin may be placed through the second set of extensions 71*b*, 72*b*, 73*h*, 81*b* and 82*b*.

The bottom chords 63 are provided with connectors that have the same configuration as the connectors 70 and 80 on the top chords 61. The compressive load bearing surfaces of these lower connectors will come into contact with one another at the same time the compressive load bearing surfaces 78 and 88 on the top connectors come into contact with one another. The lower compressive load bearing surfaces thus also act as stop surfaces, aligning the apertures in the lower connectors.

The connectors of the present invention allow sectional boom members to be connected and then rotate through a full 90° angle. Even if the boom segments are at an angle of 90° from their aligned position, first alignment surfaces 74 and second alignment surfaces 84 can be brought into contact with one another, making the apertures through the extensions close enough in alignment that a pin may be inserted. Of course after the pin is fully inserted, second alignment surfaces 84 and surfaces 74 do not contact each other. This assures that all loads are carried through the surface to surface contact of the compressive load bearing surfaces 78 and 88. Any tension loads can be carried by the pins. The compressive load bearing surfaces are preferably symmetrical about the horizontal and vertical neutral axes of the chord to which they are attached.

When the boom segments are assembled from a non-aligned arrangement as shown in either of FIG. 2, or 3, the following steps will normally occur. The two boom segments will be brought together such that two connectors 70 on the first boom segment 53 mate with two respective connectors 80 on the second boom segment 54 to form two pairs of mated connectors, but the longitudinal axes 41 of the two segments are not aligned. The remaining connectors on each segment are not coupled. Next the mated connectors are fastened together with a pivoting connection as pins are inserted though the apertures on one side of both pairs of mated connectors. The two segments 53 and 54 are then pivoted with respect to each other about the pivoting connection until the compressive load bearing surface 78 contacts the compressive load bearing surface 88. This arrangement allows the boom sections to "back bend" about either the top or bottom boom connection. The boom sections can be rotatably engaged with either the top or bottom pins inserted, then pivoted to a position where the segments are aligned and the opposite connectors can be pinned and the other pin inserted through the apertures on the inside of the top connectors.

The boom segments may also be brought together in a generally aligned position, where the connectors on the top and bottom chords contact each other at roughly the same time. It will be appreciated that with the preferred geometry of the connectors, if the boom sections are not exactly aligned as they come together, the first alignment surfaces 74 will engage the second alignment surfaces 84 and guide the connectors to slide relative to one another until the alignment surfaces 74 are fully seated in pockets 84, thus guiding the boom segments into the proper alignment such that when the engagement member and second alignment surface on both the upper and lower sets of connectors are fully engaged, the apertures through the extensions in the connectors are aligned such that a pin can be inserted through the apertures of all extensions in the first and second mating connectors.

Figures 5A, 5B:
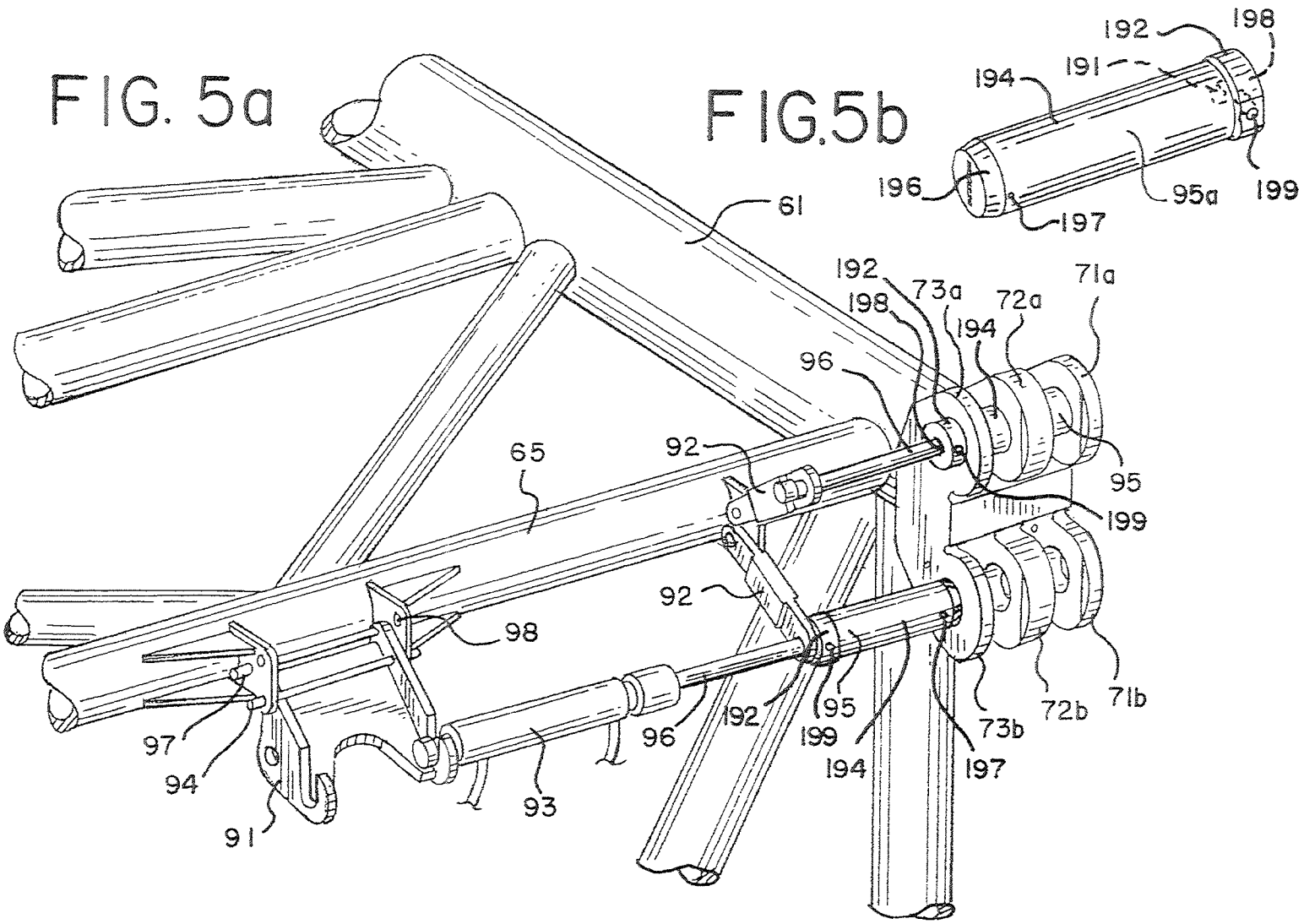
FIG. 5*a* is a top perspective view of one corner of a boom segment with a pin insertion and retraction device attached.
FIG. 5*b* is a perspective view of a pin used in the connection system of the present invention.
Figure 6:
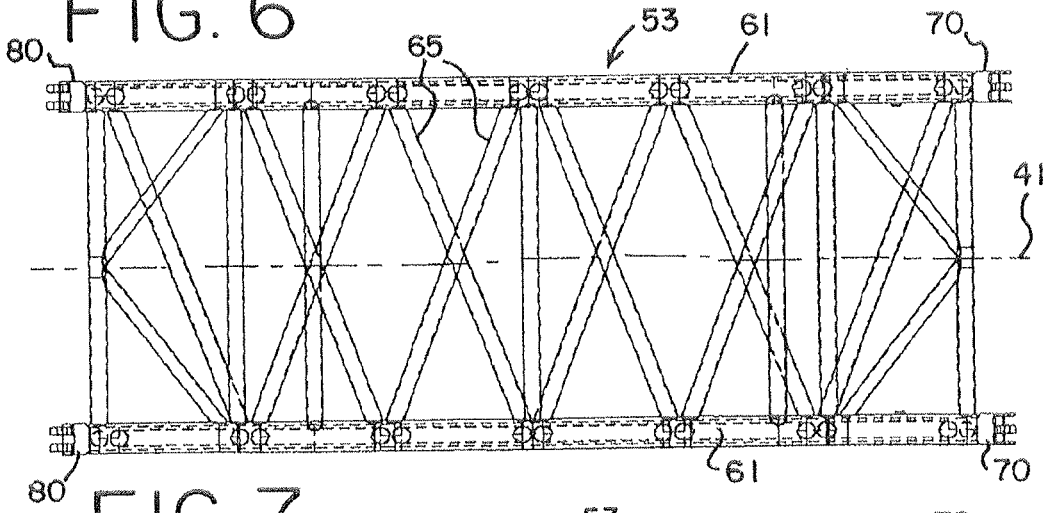
FIG. 6 is a top plan view of one of the boom segments of FIG. 2.
Figure 7:
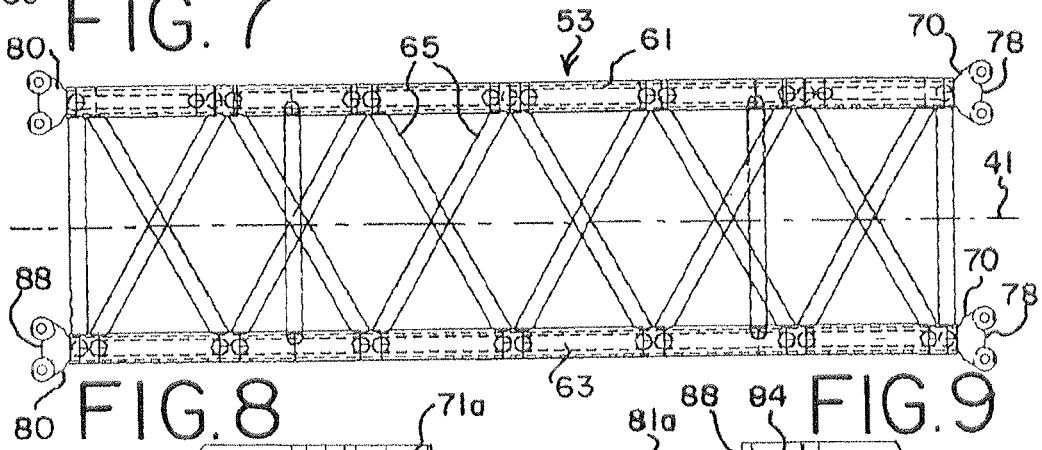
FIG. 7 is a side elevational view of one of the boom segments of FIG. 2.
Figure 8:
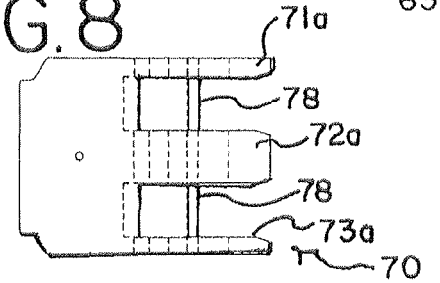
FIG. 8 is an enlarged top plan view of a female connector used on the boom segment of FIG. 6.
Figure 9:
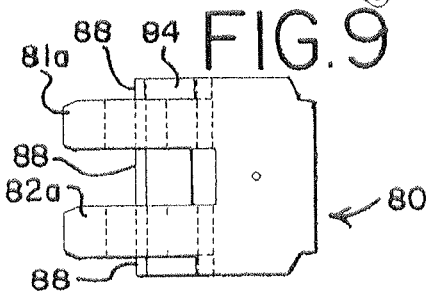
FIG. 9 is an enlarged top plan view of a male connector used on the boom segment of FIG. 6.

The boom segments preferably include brackets so that hydraulic pin insertion equipment can be mounted on the boom segment in a position to force the pin through the apertures. FIG. 5*a* shows one such configuration for a hydraulic pin inserter. Brackets 92 support the extensions 96 of pins 95 that are sized to fit in the apertures in the extensions 71, 72, 73, 81 and 82. Another bracket 91 is connected to the center of the top lacing element 65 that spans between the ends of top chords 61. A hydraulic pin insertion/retraction tool 93 with a double acting hydraulic cylinder can fit into one side of bracket 91 and connect to the extension 96 of the pin 95. Once the lower pins have been inserted. pin 94 is removed, allowing bracket 91 to pivot about pin 97 into an upper position. Pin 94 is then inserted through-holes 98 and the tool 93 can be put back into the bracket 91 and connected to the extension 96 of the upper pin 95. Retraction of the pins is carried out in a reverse operation. As will be understood in light of the below discussion, in preferred embodiments of the present invention, the hydraulic pin insertion/retraction tool 93 may only need to be used to insert one of the pins 95, and the other pin can be inserted by hand.

It has been discovered that with the connection system described above, only the top pins 95*a* need to fit tightly in the through-holes, and the other pins 95*b*, 95*c* and 95*d* making up the connection can have a loose fit. Pin 95*a* is shown in FIG. 5*b*. It has a head 192, a main body 194, and a taper 196. In addition, a counter bore 198 is made in the head 192 to provide a place for the connection of extension 96. The counter bore 198 has a threaded hole 191 in its bottom, which may be used to hold the pin for plating during the manufacturing process. A hole 199 passing all of the way through head 192 intersects the counter bore 198. A hole (not shown) is provided on the end of extension 96 that will match up with hole 199 so that a retaining pin can pass through hole 199 to connect extension 96 to pin 95*a* when the pin is being inserted or withdrawn from connector 70. Another hole 197 all the way through the body 194 of the pin 95*a* allows a retaining pin to be inserted to hold the pin 95*a* in place after it passes through the extensions of the connectors. The other pins 95*b*, 95*c* and 95*d* are formed the same way, but have a smaller diameter body.

The pin 95*a* is sized to fit tightly in the through-holes of the extensions 71*a*, 81*a*, 72*a*, 82*a* and 73*a*. While the degree of difference between the diameter of the body 194 and the diameter of the through-holes in the extensions on the connectors may vary with different sizes of column segments, in the exemplary embodiment the pin 95*a* has a diameter of 11.0.20 mm, with a tolerance of +0.00 mm, −0.08 mm, while the holes have an internal diameter of 110.40 mm, with a tolerance of +0.08 mm, −0.00 mm. The smallest possible difference between the pin diameter and the hole diameter (minimum clearance) is thus 0.20 mm. Even at the extreme ends of both tolerance ranges (minimum material), the difference between the pin and the hole diameters is 0.36 mm. The ratio of a) the difference between the inside diameter of the through-holes and the outside diameter of the tight pin to b) the outside diameter of the tight pin (referred to as X) is less than 0.0055, preferably less than 0.004, more preferably less than 0.0035, and even more preferably less than 0.002. For the above embodiment, the ratio X is 0.0018 when the pin is as large as it can be and still be within its tolerance and the hole is as small as it can be and still be within its tolerance. On the other extreme, the ratio X under minimum material conditions is 0.0033.

In the exemplary embodiment, the loose fitting pins 95*b*, 95*c* and 95*d* have a main body diameter of 109.65 mm, with a tolerance of +0.00 mm, −0.08 mm, while the size of the holes is the same. Thus the smallest possible difference between the pin diameter and the hole diameter (minimum clearance) is 0.75 mm, and the difference at the extreme ends of both tolerance ranges (minimum material) is 0.91 mm. Preferably the ratio of a) the difference between the inside diameter of the through-holes and the outside diameter of the loose fitting pins to b) the outside diameter of the loose fitting pins (referred to as Y) is greater than 0.0065, and more preferably greater than 0.007 and even more preferably greater than 0.0075. In the exemplary embodiment, the ratio Y is 0.0068 at the minimum clearance conditions, and 0.0083 at the extreme ends of the tolerance. Preferably the difference between ratios X and Y will be at least 0.003.

Another way of expressing the tight and loose pins is by comparing their relative clearance. As referred to below, M equals the difference between the inside diameter of the through-holes of the first and second connectors and the outside diameter of the tightly fitting pin. N equals the difference between the inside diameter of the through-holes of the third and fourth connectors and the outside diameter of the loose fitting pin. M is preferably less than 0.5 mm, and more preferably less than 0.4 min, and N is preferably greater than 0.6 mm and more preferably greater than 0.7 mm for large booms where the present invention is particularly useful.

The pins 95*b*, 95*c* and 95*d* and their respective holes preferably have a clearance N that is at least twice, and more preferably three times, the clearance M between pin 95*a* and the holes through which it fits, in the example given above, if pin 95*a* has a diameter of 110.16 mm (in the middle of its tolerance range) and the holes into which it fits has an internal diameter of 110.44 mm (in the middle of its tolerance range), there would be a clearance M of 0.28 mm. If the pin 95*b* had a diameter of 109.61 mm (in the middle of its tolerance range) and the holes into which it fits has an internal diameter of 110.44 mm (in the middle of its tolerance range), there would be a clearance N of 0.83 mm. The clearance N of the loose fitting pin is thus more than twice, and about three times, the clearance M of the tight fitting pin.

Figure 12:
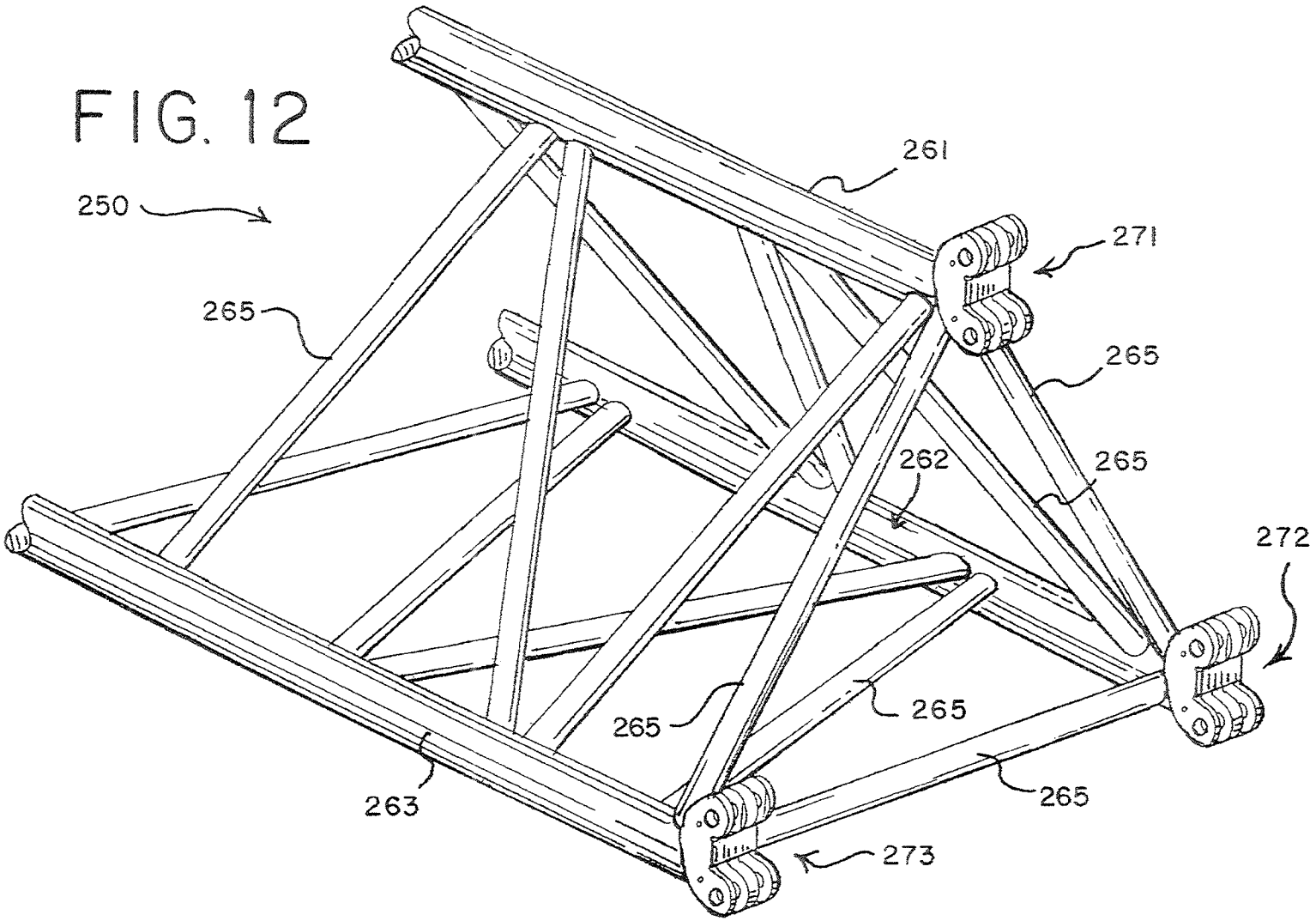
FIG. 12 is a partial perspective view of an alternate boom section utilizing the present invention.

In another embodiment of the invention each of the column segments is made from three chords and interlacing elements, and only three connectors are used to hold the first and second column segments together. One end of one of the segments 250 of this embodiment is shown in FIG. 12. The segment 250 includes three chords 261, 262 and 263 held together by lacing elements 265. As with the earlier described embodiment of FIGS. 2-11, connectors 271, 272 and 273 with two sets of three extensions each (just like connectors 70) are positioned on the ends of the chords on one end of the column segment 250, while connectors just like connectors 80 having two sets of two extensions each can be on the opposite end (not shown) of the column segment 250. While not shown, the pins used to hold the connectors 271, 272 and 273 to their mating connectors include both tight and loose fitting pins. For example, one tight fitting pin can be used in the holes in the top set of extensions in connector 271 while loose fitting pins can be used in the holes in the bottom set of extensions on connector 271 and each of the sets of extensions in connectors 272 and 273. Alternatively, two tight pins could be used in the bottom holes of connectors 272 and 273, and loose pins can be used in the top holes of connectors 272 and 273 and in both sets of holes in connector 271.

One of the benefits of either embodiment is that common castings can be used to make all connectors on the same end of the boom segment, which simplifies manufacturing. In the preferred manufacturing process, the castings are pre-machined and then welded to the chord members. The chord members are then assembled into a boom segment, and then final machining on the connectors is performed, including drilling the final bore, which is preferably the same size for all through-holes in all extensions on all connectors on the boom segment. This procedure allows the final configuration of the connectors to be made without having to worry about distortion due to welding and machining of the large boom sections.

While these large exemplary pins weigh over 25 kg, even as much as 32 kg each, they present invention allows the smaller pins 95*b*, 95*c* and 95*d* to be easily inserted after the pins 95*a* have been inserted and the boom segments rotated into place Another advantage of the present invention is particularly useful for very high capacity booms. While the connectors are primarily designed for large compressive loads, there may be times when the connectors need to be able to handle tension loads across the connections. The pins through the apertures are able to handle these tension loads.

It should be appreciated that the apparatus of the present invention is capable of being incorporated in the form of a variety of embodiments, only a few of which have been illustrated and described above. The invention may be embodied in other forms without departing from its spirit or essential characteristics. For example, instead of all of the through-holes being the same size and the tight and loose fitting pins being of different sizes, the pins could all be the same size, with the holes into which the tight pins are inserted being smaller than the holes into which the loose fitting pins are inserted. Also, rather than connectors having two sets of extensions on each connector, the invention could be used on column segments where each connector was held together with only one pin through one set of extensions. Further, rather than the sets of extensions having three extensions (71*a*, 72*a* and 73*a*) one connector and two extensions (81*a* and 82*a*) on the mating connector, connectors with fewer or more extensions could be used, though it is preferable that one of the connectors have one more extensions than the number of extensions on the mating connector. While the invention has been described as it is used on a lift crane, it could be used on column segments on other types of cranes, such as tower cranes. The described embodiments are to be considered in all respects only as illustrative and not restrictive, and the scope of the invention is therefore indicated by the appended claims rather than by the foregoing description. All changes which come within the meaning and range of equivalency of the claims are to be embraced within their scope.

The invention claimed is:

1. A crane having an upper works rotatably mounted on a lower works, the crane including at least one column member, the column member comprising:

a) at least a first and a second column segment each with a longitudinal axis and a first and a second end, the second end of the first segment being coupled to the first end of the second segment;

b) at least a first, a third and a fifth connector on the second end of the first segment respectively mating with at least a second, a fourth and a sixth connector on the first end of the second segment;

c) each of the connectors comprising at least a first extension having a through-hole there through, the through-hole having an axis perpendicular to said longitudinal axis and positioned in the extension such that the through-holes of mating connectors are aligned when the column segments are aligned;

d) each of the connectors comprising a compressive load bearing surface, the compressive load bearing surfaces being positioned to carry compressive loads between the first and second column segments when the column segments are aligned;

e) a first pin manufactured to fit tightly through the through-hole of the first extension on the first connector and the through-hole of the first extension on the second connector to hold the first and second connectors together; and a second pin manufactured to fit loosely through the through-hole of the first extension on the third connector and the through-hole of the first extension on the fourth connector on the first end of the second segment to hold the second and fourth connectors together;

f) wherein the inside diameters of all holes through which the first pin extends are the same as one another, and the inside diameters of all holes through which the second pin extends are the same as one another; and g) wherein the ratio of N to M is at least 2, where:

i) M equals the difference between the inside diameter of the through-holes of the first and second connectors and the outside diameter of the first pin, and ii) N equals the difference between the inside diameter of the through-holes of the third and fourth connectors and the outside diameter of the second pin.

2. The crane of claim 1 wherein the inside diameters of all holes through which the first pin extends and all holes through which the second pin extends are the same.

3. The crane of claim 1 wherein X is less than 0.0055 and X equals the ratio of:

i) the difference between the inside diameter of the through-holes of the first and second connectors and the outside diameter of the first pin to ii) the outside diameter of the first pin.

4. The crane of claim 1 wherein Y is greater than 0.0065 and Y equals the ratio of:

i) the difference between the inside diameter of the through-holes of the third and fourth connectors and the outside diameter of the second pin to ii) the outside diameter of the second pin.

5. The crane of claim 1 wherein the difference between X and Y is greater than 0.003, where:

X equals the ratio of i) the difference between the inside diameter of the through-holes of the first and second connectors and the outside diameter of the first pin to ii) the outside diameter of the first pin, and Y equals the ratio of i) the difference between the inside diameter of the through-holes of the third and fourth connectors and the outside diameter of the second pin to ii) the outside diameter of the second pin.

6. The crane of claim 1 wherein M is less than 0.5 mm, and N is greater than 0.6 mm.

7. The crane of claim 1 wherein each column segment comprises four chords, and further comprising a seventh connector on the second end of the first segment respectively mating with an eighth connector on the first end of the second segment.

8. The crane of claim 1 wherein each of the connectors further comprises at least a second extension having a through-hole there through, each through-hole having an axis that is parallel to, but offset compared to, the axis of the through-hole of the other extension on the connector; and a third pin fitting loosely through the through-holes of the first and second connectors' second extensions to further hold the first and second connectors together, and a fourth pin fitting loosely through the through-holes of the third and fourth connectors' second extensions to further hold the third and fourth connectors together.

9. The crane of claim 1 wherein the first, third, and fifth connectors each comprise two sets of three extensions and the second, fourth and sixth connectors each comprise two sets of two extensions, each extension of the second, fourth and sixth connectors fitting between extensions respectively on the first, third, and fifth connectors when the column segments are connected in their operational position, and wherein additional pins are employed, with two pins used to connect each pair of connectors, with the additional pins fitting loosely.

10. The crane of claim 1 wherein the first and second column segments each comprise four chords with intermediate lacing elements there between, each of the chords having first and second ends corresponding to the first and second ends of the column segments; and wherein two of said four chords comprise top chords and the other two of said four chords comprise bottom chords when the column segments are being connected, and the first pin and an additional tight fitting pin are used to connect connectors adjacent the top chords.

11. The crane of claim 10 wherein the inside diameters of the through-holes on each of the six connectors are all the same as one another, and the outside diameter of the first pin is the same as the outside diameter of the additional tight fitting pin.

12. The crane of claim 1 wherein the column member comprises a boom member supporting a load hoist line when the crane is in operation.

13. A mated connection between two sectional column members comprising:

a) a first connecter affixed to an end of a first sectional column member and a second connector affixed to an end of a second sectional column member;

b) each first and second connector having a first and second set of extensions, with each extension having a through-hole there through sized to receive a pin;

c) each connector also comprising a compressive load bearing surface positioned between the first set and second set of extensions, the compressive load bearing surface of the first connector being in face-to-face relationship with the compressive load bearing surface of the second connector; and d) a first pin passing through the through-holes of the first set of extensions of the first connector and the first set of extensions of the second connector in a tight fitting manner, and a second pin passing through the through-holes of the second set of extensions of the first connector and the second set of extensions of the second connector in a loose fitting manner;

e) wherein the inside diameters of all holes through which the first pin passes are the same as one another, and the inside diameters of all holes through which the second pin passes are the same as one another;

f) wherein X equals the ratio of: i) the difference between the inside diameter of the through-holes of the first sets of extensions on the first and second connectors and the outside diameter of the first pin to ii) the outside diameter of the first pin;

g) wherein Y equals the ratio of: i) the difference between the inside diameter of the through-holes of the second sets of extensions on the first and second connectors and the outside diameter of the second pin to ii) the outside diameter of the second pin; and h) wherein the difference between X and Y is greater than 0.003.

14. The mated connection of claim 13 wherein the number of extensions in the first set of extensions on the first connector is equal to the number of extensions in the second set of extensions on the first connector.

15. The mated connection of claim 13 wherein there are an odd number of extensions in the first set of extensions on the first connector and an even number of extensions in the first set of extensions on the second connector.

16. A method of connecting first and second segments of a lift crane column, the column segments each comprising a longitudinal axis and at least three chords, with each of the chords having a connector on each end thereof, the method comprising:

a) bringing the two column segments together such that at least one extension having a through-hole there through on at least a first connector on the first column segment is interleaved respectively with at least two extensions having a through-hole there through on at least a second respective connector on the second column segment to form at least a first pair of mated connectors, with the through-holes in the connector extensions being generally aligned;

b) fastening the mated first and second connectors together with a first pin that fits tightly in the through-holes of the extensions, providing a pivoting connection;

wherein the through-holes of the extensions all have the same inside diameter as one another, and the ratio of: i) the difference between the inside diameter of the through-holes of the extensions and the outside diameter of the first pin to ii) the outside diameter of the first pin is less than 0.0055; and c) pinning the previously non-coupled connectors to their respective mating connector with a loose fitting pin, wherein the loose fitting pin extends through through-holes of extensions on the respective mating connectors, and the through-holes of the extensions that each loose fitting pin extends through all have the same inside diameter as one another, and the ratio of i) the difference between the inside diameter of the through-holes of the extensions and the outside diameter of the pin extending through those extensions to ii) the outside diameter of the pin extending through those extensions is greater than 0.0065.

17. The method of claim 16 further comprising the step, between steps b) and c), of pivoting the two segments with respect to each other about the pivoting connection until a stop surface on the non-coupled connectors of the first segment contacts a stop surface on the non-coupled connectors of the second segment.

18. The method of claim 17 wherein the stop surface on the non-coupled connectors of the first segment and the stop surface of the non-coupled connectors of the second segment both comprise compressive load bearing surfaces.

19. The method of claim 16 wherein each of the first and second segments of a lift crane column comprise four chords, with each of the chords having a connector on each end thereof.

20. The method of claim 19 wherein each connector comprises two sets of extensions each with a through-hole there through, and a total of eight pins are used to connect the four connectors on each of the two ends of the column segments, with two of the pins fitting tightly in their through-holes, and six of the pins fitting loosely in their through-holes.

* * * * *